United States Patent [19]

Gibson et al.

[11] Patent Number: 4,785,778

[45] Date of Patent: Nov. 22, 1988

[54] ENGINE GOVERNOR WITH DUAL REGULATION

[75] Inventors: Dennis H. Gibson, Edelstein; Ralph Tegg, Jr., Peoria, both of Ill.

[73] Assignee: Caterpillar Inc., Peoria, Ill.

[21] Appl. No.: 575,345

[22] Filed: Jan. 31, 1984

Related U.S. Application Data

[63] Continuation of Ser. No. 261,120, Sep. 15, 1980, abandoned.

[51] Int. Cl.[4] ..... F02M 39/00

[52] U.S. Cl. ..... 123/373; 123/365; 123/385; 123/372

[58] Field of Search ..... 123/365, 367, 372, 373, 123/377, 385, 388, 357–359, 379

[56] References Cited

U.S. PATENT DOCUMENTS

| | | | |
|---|---|---|---|
| 2,563,822 | 8/1951 | Dolza et al. | 123/373 |
| 2,721,072 | 10/1955 | Zuhn et al. | 123/373 |
| 2,812,043 | 11/1957 | Wilson | 123/373 |
| 2,821,091 | 1/1958 | Benner . | |
| 2,961,229 | 11/1960 | Parks | 123/364 |
| 3,313,283 | 4/1967 | Miller | 123/373 |
| 3,672,385 | 6/1972 | Matzen | 123/373 |
| 3,698,369 | 10/1972 | Vuaille | 123/373 |
| 3,885,442 | 5/1975 | Staebler | 123/372 |
| 3,915,140 | 10/1975 | Parks | 123/372 |
| 4,252,089 | 2/1981 | Kramer | 123/365 |

FOREIGN PATENT DOCUMENTS

| | | | |
|---|---|---|---|
| 028965 | 1/1953 | Fed. Rep. of Germany . | |
| 2430044 | 1/1976 | Fed. Rep. of Germany | 123/388 |
| 27-3521 | 9/1952 | Japan . | |

*Primary Examiner*—Carl S. Miller

*Attorney, Agent, or Firm*—Wood, Dalton, Phillips, Mason & Rowe

[57] ABSTRACT

A governor (11) for providing at least two different regulation factors for an internal combustion engine (10) including a fuel injection system (12). The governor (11) includes a rotatable flyweight assembly (18,20,22) adapted to be mechanically connected (24) to the engine (10) to be driven thereby. A first spring (28) may be compressed by the flyweight assembly (18,20,22) proportional to engine speed. The flyweight assembly (18,20,22) is adapted to be connected to the engine fuel injection system (12) by a rack (14) and a control level (34) abuts the first spring (28), in opposition to the flyweight assembly (18,20,22). The governor (11) includes a second compressible spring (70) along with an actuator (56,58) for selectively engaging and disengaging the control lever (34). One regulation factor is provided when the second spring (70) is engaged with the control lever (34) and a second, different regulation factor is provided when the second spring (70) is disengaged from the control lever (34), with engine governing being provided solely by the first spring (28).

8 Claims, 1 Drawing Sheet

ENGINE GOVERNOR WITH DUAL REGULATION

This is a continuation of application Ser. No. 261,120, filed Sept. 15, 1980, now abandoned.

DESCRIPTION

1. Technical Field

This invention relates to a governor for fuel injected internal combustion engines, and more specifically, to such a governor that provides a plurality of different regulation factors.

2. Background Art

Prior art of possible relevance includes the following U.S. Pat. Nos.: 2,563,822 issued Aug. 14, 1951 to Dolza et al; 2,767,594 issued Oct. 23, 1956 to Du Shane; 2,812,043 issued Nov. 5, 1957 to Wilson; 2,821,091 issued Jan. 28, 1958 to Benner; 2,825,238 issued Mar. 4, 1958 to Lofthouse; 2,961,229 issued Nov. 22, 1960 to Parks; 3,313,283 issued Apr. 11, 1967 to Miller; 3,337,870 issued Apr. 16, 1968 to Miller; 3,532,082 issued Oct. 6, 1970 to Clouse; and 4,109,628 issued Aug. 29, 1978 to Miller et al. Of the above, perhaps the Clouse et al patent is the most relevant.

Governors for fuel injected internal combustion engines typically include a so-called flyweight assembly which is driven by the engine and which, proportional to engine speed, compresses a spring. The spring is also compressed by a control assembly such as a throttle linkage and the axial length of the spring, and changes therein due to varying compression, dictates the amount of fuel injected into the engine. In the usual case, positioning of conventional racks which control individual fuel injectors is proportional to the axial length of the spring.

The governing of the engine speed is achieved generally as follows. For a given throttle setting, under a no-load condition, the engine speed will be at some predetermined value. If a load is applied to the engine, and no commensurate increase in fuel is provided, the engine will begin to slow down under the load. As a result, flyweights in the governor will move radially inwardly since the centrifugal force moving the flyweights outwardly will decrease with the decreasing engine speed. This movement of the flyweights will lessen the degree of compression of the spring so that the spring's axial length will increase. This change in length in turn will cause movement of the fuel injector rack to increase the quantity of fuel injected. With increasing fuel being injected, engine speed will tend to increase. In a properly adjusted system, within a short period of time, the engine will operate at a desired loaded speed generally somewhat different than the no-load speed for the same throttle setting.

When a loaded engine at a given throttle setting and engine speed has the load removed, the engine will begin to speed up assuming fuel supply has not diminished. As a consequence the flyweights of the flyweight assembly will move radially outwardly, this time decreasing the axial length of the spring. This in turn will cause movement of the fuel injector rack to decrease the amount of fuel being injected thereby decreasing engine speed. Again, in a short period of time, in a properly adjusted system, the various forces involved will balance out restoring the engine to a desired no-load engine speed, generally somewhat different than the loaded speed for the same throttle setting.

In the usual case, the no-load speed of the given throttle setting will be somewhat higher than the loaded speed for the same throttle setting, although such is not always the case. The percent difference between the two speeds, that is, no-load speed and loaded speed for the same throttle setting is termed "regulation factor". For example, if, at a given throttle setting, the loaded speed of an engine is 2,000 RPM, and the no-load speed of the engine for the same throttle setting is 2,200 RPM, there is a 10% regulation factor.

The regulation factor of an engine at a given throttle setting is proportional to the spring rate of the spring employed in the governor utilized on the engine. However, the regulation factor for a given engine does not remain constant for all throttle settings. Rather, it will vary, and may vary over a considerable range and may even become negative, i.e., when load is removed from the engine, engine speed would decrease. Since the purpose of a governor is to reduce fuel flow when engine speed increases over a desired amount, and to increase fuel flow when engine speed decreases below a desired amount, the negative regulation factor would cause the opposite to occur and could result in an unstable situation to the extent that a steady state engine speed for a given loading could never be attained.

These considerations have provided considerable difficulty in applications wherein a single fuel injected internal combustion engine is intended to be used, at different times, for two rather diverse purposes. One such application is where the engine is utilized to propel a vehicle at varying speeds on one occasion and, on other occasions, is utilized to perform work of a completely different character typically requiring substantially constant speed engine output. Specific examples would include a diesel engine utilized in a truck as well as for power generation purposes or for operating hydraulic systems as, for example, in a refuse truck with refuse compaction systems.

In operating the engine to drive the vehicle, a relatively high regulation factor is tolerable and even desirable. For as the operator of the vehicle adds load to the vehicle, as by driving up a hill, a relatively high regulation factor will allow the engine to slow down noticeably indicating to the operator that a higher throttle setting and/or change in gear ratio is required. Conversely, in, for example, power generation applications, a relatively low regulation factor is desirable to prevent severe fluctuations in output frequency that would be associated with fluctuating engine speeds imposed by varying loads.

Because of the considerations previously set forth herein, it is not practical in the overwhelming majority of instances to select the lowest desirable regulation factor required of the engine for one purpose and apply it for the other. For example, in one application wherein the engine is utilized alternatively for propelling a vehicle and for power generation, for the vehicle propulsion application, the engine might be selected to provide 245 brake horsepower at 2100 RPM for normal highway operation and a governor spring selected to provide an 8.6% regulation factor at that engine speed. The same governor spring, at 1300 RPM whereat the engine would develop 150 brake horsepower would provide a 30% regulation factor, totally unsatisfactory for power generation at 1300 RPM and 150 brake horsepower where a 3% regulation factor is desired.

Conversely, if a governor spring where selected to provide a 3% regulation factor at 1300 RPM, it can be shown that such a spring would provide a −7% regulation factor at 2100 RPM; and of course, such a negative regulation factor is obviously undesirable.

Thus, in order to adapt the engine to operate in either mode, it is necessary that some means of changing the spring rate of the governor spring be provided so as to provide for the two differing regulation factors called for by the two differing applications. This, in turn, presents difficulties in terms of the difficulty of conversion as well as obtaining, accurately, the desired different regulation factor in the conversion process. It is further compounded in applications such as mentioned by the presence of the throttle linkage required to provide variable engine speeds for normal highway use. Moreover, the very nature of the conversion in such applications requires that it occur after the truck has been driven to a point whereat engine use is to be changed and again at such point before the engine use is changed back to that of a truck. In these cases, sophisticated equipment by which accurate change in regulation factor can be readily determined is seldom available thus adding considerably to the inefficiency and inaccuracy of the conversion process.

Heretofore, such changes in regulation factor in dual application situations has been by way of attaching a second spring to a portion of the throttle linkage, externally of the engine or governor. This frequently requires the disconnection of part of the throttle linkage to the throttle operator for the vehicle and requires mechanical aptitude and skill to make the installation properly. It also requires resetting of the engine power setting and high idle speed for the engine under a no-load condition which is extremely difficult to do in the field where such conversions must be made in the vast majority of cases.

DISCLOSURE OF THE INVENTION

The present invention is directed to overcoming one or more of the problems as set forth above.

According to the present invention, a governor for providing at least two different regulation factors for a fuel injected internal combustion engine has a rotatable flyweight assembly adapted to be driven by the engine. A first spring is disposed to be compressed by the flyweight assembly proportional to engine speed and one of the flyweight assembly and the first spring is adapted to be connected to a fuel injection system for the engine to control the same. A control lever is associated with the first spring in opposition to the flyweight assembly for compressing the first spring proportional to a desired engine speed. There is further provided a second compressible spring along with means for selectively engaging or disengaging the control lever and the second spring to provide one regulation factor when the second spring is engaged with the control lever and a second, different regulation factor when the second spring is disengaged from the control lever.

Other objects and advantages will become apparent from the following specification taken in connection with the accompanying drawings.

BRIEF DESCRIPTION OF THE DRAWING

The single FIGURE is a partial schematic, partial mechanical drawing of a governor made according to the invention with parts shown in section for clarity.

BEST MODE FOR CARRYING OUT THE INVENTION

Figure 1:
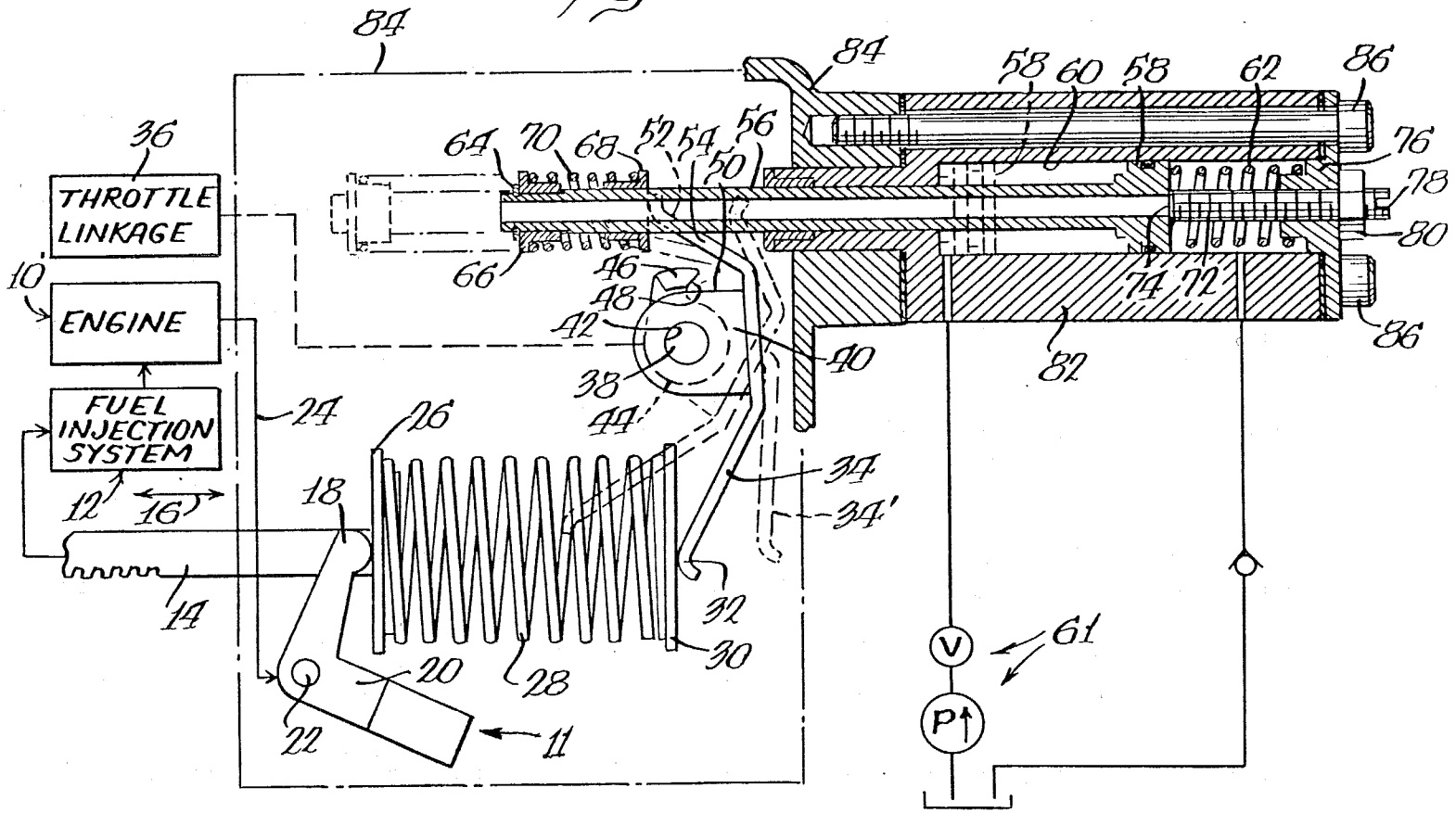

An exemplary embodiment of a governor 11 made according to the invention is illustrated in the FIGURE in connection with a diesel engine, shown schematically at 10, and which is provided with a fuel injection system. shown schematically at 12, typically of the type wherein the amount of fuel delivered during each injection cycle is controlled by the position of a reciprocal rack 14 movable in a path illustrated by an arrow 16. The position of the rack 14, and thus the quantity of fuel injected, is controlled by a connection, directly or indirectly, to the toes 18 of a plurality of flyweights 20, only one of which is shown. The flyweights 20 are mounted by pivots 22 and additionally, are rotatable and adapted to be driven by the engine 10 as schematically illustated at 24. Various constructions for the flyweights 20, the pivots 22 and the rotatable drive 24 are well known and form no part of the present invention.

The toes 18 of the flyweights 20 bear against a plate 26 abutting one end of a main governor spring 28. The opposite end of the spring 28 is abutted by a plate 30 which in turn is positioned by one end 32 of a control lever 34 and again, the construction can be according to any known means. The control lever 34 is operable, as will be seen, to compress the spring 28 in accordance with a desired throttle setting. At the same time, the toes 18 of the flyweights 20 operate to compress the spring 28 dependent upon actual engine speed. The position of the rack 14, and thus the quantity of fuel injected, is dependent upon the position of the lefthand end of the spring 28 is viewed in the FIGURE which in turn is dependent upon the amount of compression of the spring 28 as well as the relative positions of the control lever 34 and the flyweights 20. For the configuration illustrated in FIG. 1, as engine speed decreases, the amount of centrifugal force on the flyweight 20 will decrease and the compression of the spring 28 will decrease while at the same time moving the flyweight 20 in a counterclockwise direction about the pivot 22 thereby moving the rack 14 to the left to increase the amount of fuel injected. Conversely, as engine speed increases, the centrifugal force applied to the flyweight 20 will increase thereby causing the same to pivot in a clockwise direction about the pivot 22 to increase compression on the spring 28 thereby moving the rack 14 to the right to decrease the quantity of fuel injection. Analysis will show that moving the end 32 of the control lever 32 to the right will have the effect of causing the rack 14 to move to the right to decrease fuel quantity while moving the end 32 to the left will ultimately result in an increasing fuel flow.

Movement of the lever 34 is effected, in one mode of operation, by a throttle linkage shown schematically at 36. The throttle linkage 36 is connected to a rotary shaft 38. The lever 34, intermediate its ends, includes at least one apertured tongue 40. The aperture 42 in the tongue mounts the lever 34 for rotation on the shaft 38. That is, the lever 34 is not fixed to the shaft 38 for rotation therewith but may rotate relative thereto for certain conditions to be seen.

The shaft 38 fixedly mounts a collar 44 which in turn includes an axial projection 46 which is designed to overlie one of the tongues 40. One side surface 48 of the projection is adapted to engage an edge 50 of the tongue 40 when the shaft 38 is rotated sufficiently clockwise to cause engagement between the two. When the side surface 48 and the edge 50 are not in engagement with each other, relative rotation between the lever 34 and the shaft 38 may occur.

The end 52 of the lever 34 opposite the end 32 is bifurcated as by a central slot having a bottom shown at 54. Received within the slot is an elongated piston rod 56 mounting a piston 58 on one end thereof. The piston 58 is received reciprocally in a cylinder bore 60. Fluid under pressure may be ported by means 61 to the left side of the piston 58 to drive the same to the solid line position illustrated in the FIGURE within the bore 60. The bore 60 also contains a return spring 62 for driving the piston 58 to the dotted line position within the bore 60.

The end of the piston rod 56 remote from the piston 58 mounts a retainer 64 against which is abutted a stepped bushing 66. Reciprocally mounted on the piston rod 56 is an oppositely directed, but similar stepped bushing 68 and a compressible coil spring 70 is mounted between flanges of the respective bushings 66 and 68. The bifurcated end 52 of the control lever 34 is abutted by the bushing 68 when the piston 58 is in the solid line position illustrated in the drawing. Conversely, when the piston 58 is shifted to the dotted line position illustrated in the FIGURE, the bushings 66 and 68 and the spring 70 are moved to the dotted line position illustrated along the reciprocal path of the piston rod 56 to a location completely disengaged from the end 52 of the lever 34. Such a position is sufficiently remote that no contact with the lever 34 will be established even when the lever 34 is in its most counterclockwise position shown at 34' in the drawing.

When the piston 58 is moved to the solid line position, at some point in such movement, engagement will be established between the lever 34 and the bushing 68 with the result that the spring 70 will be compressed to some predetermined degree and thus tend to bias the lever 34 against the main governor spring 28.

The degree of compression of the spring 70 will depend upon the extent to which the piston 58 moves to the right as viewed in the FIGURE and this is limited by an adjustable stop 72 in the form of a threaded shaft having a end 74 which may abut the piston 58. The adjustable stop 72 is threaded in an end cap 76 for the bore 60 and extends externally thereof to terminate in a slotted operator 78. A screwdriver may be inserted in the slotted operator 78 to adjust the axial position of the stop 72 within the bore 60 and once the desired position is attained, a lock nut 80 may be tightened to maintain such positioning.

The end cap 76 closes one end of the bore 60 in a housing part 82 which in turn is fastened to a main housing 84 by means of cap screws 86 or the like. The housing 84 extends about the various components illustrated, the major ones of which include the flyweight assembly, the springs 28 and 70, the control lever 34, the control shaft 38, the limited lost motion connection defined by the side surface 48 and the edge 50, and with the housing part 82 enclose the piston 58 as well as the adjustable stop 72.

Industrial Applicability

While the invention has utility in any engine application wherein dual regulation of the engine 10 is desirable or required, for purposes of illustrating its industrial applicability, it will be considered in connection with the example previously offered, that is, an engine 10 intended to develop 245 brake horsepower at 2100 RPM with 8.6% regulation factor for propelling a truck in normal highway operation and for developing 150 brake horsepower at 1300 RPM with a 3% regulation factor.

After selection of an appropriate engine 10 and fuel injection system 12 is made, and a particular governor 11 operable therewith has been selected, the main governor spring 28 is chosen by known methods to have a spring rate that will provide the 8.6% regulation factor desired at 2100 RPM. The throttle linkage 36 is placed in the low idle position, for example, one whereat engine speed will be approximately 600 RPM under a no-load condition. The collar 44 is then fixed to the shaft 38 at an angular position whereat the side surface 48 of the projection 46 is in virtual contact with the edge 50 when the lever 34 is positioned with respect to the flyweights 20 to provide for a positioning of the rack 14 corresponding to 600 RPM under no load.

The throttle linkage 36 is such as to rotate the shaft 38 in a clockwise direction as viewed in the FIGURE when an increasing throttle setting is desired and when such occurs, the projection 46 engages the lever 34 to rotate the same clockwise and compress the main governor spring 28 as required by the operator of the vehicle in normal highway use.

At this time, the piston 58 is in its dotted line position, being urged thereto by the return spring 62 and does not affect engine operation.

When it is desired to change the regulation factor on the engine 10 for power generation, the throttle linkage 36 is returned to its low idle position, typically by a spring in the linkage itself without any intervention by the operator. Fluid under pressure is applied by means 61 to the left side of the piston 58 to drive the same against the stop 72. This in turn brings the bushing 68 into contact with the lever end 52 and provides some degree of compression of both the spring 70 and the spring 28. It will be appreciated that upon such occurrence, the springs 28 and 70 will be acting in series against the toes 18 of the flyweights 20 and thus, the spring rate of the system will be different from the spring rate of the spring 28 alone. The spring 70 is chosen to have a spring rate which, when the geometry of the lever 34 is also considered, when combined with the spring rate of the spring 28 will provide a system spring rate that will correspond to a 3% regulation factor at 1300 RPM. The stop 72 is, of course, adjusted to limit movement of the spring 70 to a position that provides the desired fixed engine speed, here 1300 RPM.

When it is desired to revert to the higher engine speed and higher percent regulation factor, fluid pressure applied to the piston 58 is released by means 61 and the return spring 62 will move the spring 70 out of contact with the control lever 34 and engine speed regulation will be solely under the influence of the main governor spring 28.

Those skilled in the art will appreciate that many advantages accrue from the invention. Firstly, and most importantly, accurate dual regulation is provided. Secondly, the operator, in changing from one regulation factor to another, need do nothing more than "push a button" to cause the piston 58 to be pressurized or vice versa. Alternately, a solenoid could be used in lieu of the piston 58. No mechanical skill or understanding of the system is required and the operator need not make any mechanical alteration to the system which could then be time consuming, possibly improperly accomplished, and inaccurate.

The two regulation factors may be accurately set at the factory using sophisticated equipment such as dynomometers and ordinarily will require no adjustment in the field. However, where adjustment may be required, it can be accomplished through the simple act of utilizing the external operator 78 for the stop 72.

All regulating components are contained within the housing defined by elements 82 and 84 and therefore are essentially tamperproof.

There is no need to disconnect any part of the throttle linkage 36 when conversion from one regulation factor to another is made by reason of the limited lost motion connection between the throttle linkage and the control lever 34 provided by the projection 46 and its side surface 48 and the edge 50.

The system is practical in applications where more than two regulation factors are required simply by lengthening the lever end 52 and adding additional components corresponding to the spring 70 and the piston 58 configured to provide additional system spring rate variations.

We claim:

1. In a governor (11) for providing at least two different regulation factors for an internal combustion engine (10) wherein regulation factor is defined as the percent difference between no-load speed and loaded speed for the same throttle setting, the engine (10) including a fuel injection system (12) and a throttle linkage (36), the governor (11) being of the type having a rotatable flyweight assembly (18, 20, 22) adapted to be driven by the engine (10), a first spring (28) disposed to be compressed by the flyweight assembly (18, 20, 22) proportional to engine speed, and a control lever (34) associated with the first spring (28) for opposing the force of the flyweight assembly (18, 20, 22), said control lever (34) compressing the first spring (28) proportional to a desired engine speed, the flyweight assembly (18, 20, 22) and the first spring (28) being adapted to be connected to the fuel injection system (12), the improvement comprising:

a second compressible spring (70); and actuator means (56, 58, 60, 62, 64, 66, 68) for selectively engaging and disengaging said second spring (70) from said control lever (34) to provide a first regulation factor based on the combined chosen spring rates of said first and second springs (28, 70) when said second spring (70) is engaged with said control lever (34) and a second different regulation factor based on the chosen spring rate of said first spring (28) alone when said second spring (70) is completely disengaged from said control lever (34).

2. A governor (11) according to claim 1 further including means defining a limited lost motion connection (46, 48, 50) to allow free movement between the control lever (34) and the throttle linkage (36) for at least one predetermined position of said control lever (34) and to cause said control lever (34) to be actuatable by said throttle linkage (36) for at least one other predetermined position of said control lever (34).

3. The governor (11) of claim 1 wherein said control lever (34) has first and second ends (32,52) and is pivoted intermediate its ends (32,52), the first end (32) being engaged with said first spring (28) and the second end (52) being selectively engageable and completely disengageable with said second spring (70).

4. The governor (11) of claim 1 wherein said second spring (70) is mounted for reciprocal movement in a path intersecting said control lever (34) and said actuator means (56,58,60,62,64,66,68) includes a motor (58,60) for moving said second spring (70) in said path.

5. The governor (11) of claim 4 further including an adjustable stop (72,74,78) for limiting movement of said second spring (70) in said path in the direction toward engagement with said control lever (34), said stop (72,74,78) being adjustable to set engine speed at said first regulation factor.

6. In a governor (11) for providing at least two different regulation factors for an internal combustion engine (10) including a fuel injection system (12) and a throttle linkage (36), the governor (11) being of the type having a rotatable flyweight assembly (18, 20, 22) adapted to be driven by the engine (10), a first spring (28) disposed to be compressed by the flyweight assembly (18, 20, 22) proportional to engine speed, and a control lever (34) associated with the first spring (28) for opposing the force of the flyweight assembly (18, 20, 22), said control lever (34) compressing the first spring (28) proportional to a desired engine speed, the flyweight assembly (18, 20, 22) and the first spring (28) being adapted to be connected to the fuel injection system (12), the improvement comprising:

a second compressible spring (70); and actuator means (56, 58, 60, 62, 64, 66, 68) for selectively engaging and disengaging said control lever (34) and said second spring (70) to provide a first regulation factor when said second spring (70) is engaged with said control lever (34) and a second different regulation factor when said second spring (70) is disengaged from said control lever (34), said improvement further including a rotatable control shaft (38), means (42) for rotatably mounting said control lever (34) on said control shaft (38), a limited lost motion connection (46, 48, 50) extending between said control shaft (38) and said control lever (34) to allow free movement therebetween for at least one predetermined angular position of said control shaft (38) and to cause said control lever (34) to be rotatable with said control shaft (38) for at least one other predetermined angular position of said control shaft (38).

7. The governor (11) of claim 6 wherein said one predetermined angular position corresponds to an engine low idle speed.

8. The governor (11) of claim 7 wherein said first and second springs (28,70), said control lever (34), said control shaft (38), said flyweight assembly (18,20,22), said rotatably mounting means (42), said limited lost motion connection (46,48,50) and said actuator means (56,58,60,62,64,66,68) are all contained within a housing (82,84), and said actuator means (56,58,60,62,64,66,68) includes within said housing (82,84) means (56) for movably mounting said second spring (70) for movement between positions engaged with and disengaged from said control lever (34), an adjustable stop (72,74) within said housing (82,84) for limiting movement of said second spring (70) towards said engaged position, and an operator (78) external of said housing (82,84) for adjusting said stop (72,74).

* * * * *